US007735449B1

(12) United States Patent
Harold et al.

(10) Patent No.: US 7,735,449 B1
(45) Date of Patent: Jun. 15, 2010

(54) STENT FIXTURE HAVING ROUNDED SUPPORT STRUCTURES AND METHOD FOR USE THEREOF

(75) Inventors: Nathan Harold, San Jose, CA (US); Antonio Garcia, San Jose, CA (US); Andrew Tochterman, Palo Alto, CA (US)

(73) Assignee: Advanced Cardiovascular Systems, Inc., Santa Clara, CA (US)

( * ) Notice: Subject to any disclaimer, the term of this patent is extended or adjusted under 35 U.S.C. 154(b) by 240 days.

(21) Appl. No.: 11/193,849

(22) Filed: Jul. 28, 2005

(51) Int. Cl.
*B05C 13/02* (2006.01)

(52) U.S. Cl. ..... 118/500; 623/1.46; 623/1.47; 623/1.48; 606/194

(58) Field of Classification Search ..... 118/500, 118/504, 505; 623/1.46, 1.47, 1.48; 606/194
See application file for complete search history.

(56) References Cited

U.S. PATENT DOCUMENTS

| | | | |
|---|---|---|---|
| 2,072,303 | A | 3/1937 | Hermann et al. |
| 2,386,454 | A | 10/1945 | Frosch et al. |
| 2,845,346 | A | 7/1958 | Scanlon et al. |
| 3,016,875 | A | 1/1962 | Ballentine, Jr. et al. |
| 3,773,737 | A | 11/1973 | Goodman et al. |
| 3,827,139 | A | 8/1974 | Norteman |
| 3,849,514 | A | 11/1974 | Gray, Jr. et al. |
| 3,882,816 | A | 5/1975 | Rooz et al. |
| 3,995,075 | A | 11/1976 | Cernauskas et al. |
| 4,011,388 | A | 3/1977 | Murphy et al. |
| 4,082,212 | A | 4/1978 | Headrick et al. |
| 4,201,149 | A | 5/1980 | Koester et al. |
| 4,226,243 | A | 10/1980 | Shalaby et al. |
| 4,269,713 | A | 5/1981 | Yamashita et al. |
| 4,290,383 | A | 9/1981 | Pfender |
| 4,329,383 | A | 5/1982 | Joh |
| 4,343,931 | A | 8/1982 | Barrows |
| 4,459,252 | A | 7/1984 | MacGregor |
| 4,489,670 | A | 12/1984 | Mosser et al. |
| 4,529,792 | A | 7/1985 | Barrows |
| 4,560,374 | A | 12/1985 | Hammerslag |
| 4,611,051 | A | 9/1986 | Hayes et al. |
| 4,616,593 | A | 10/1986 | Kawamura et al. |
| 4,629,563 | A | 12/1986 | Wrasidlo |
| 4,640,846 | A | 2/1987 | Kuo |
| 4,656,242 | A | 4/1987 | Swan et al. |
| 4,733,665 | A | 3/1988 | Palmaz |

(Continued)

FOREIGN PATENT DOCUMENTS

| | | |
|---|---|---|
| DE | 42 24 401 | 1/1994 |

(Continued)

OTHER PUBLICATIONS

Anonymous, *Cardiologists Draw—Up the Dream Stent*, Clinica 710:15 (Jun. 17, 1996), http://www.dialogweb.com/cgi/document?reg=1061848202959, printed Aug. 25, 2003 (2 pages).

(Continued)

*Primary Examiner*—Laura Edwards
(74) *Attorney, Agent, or Firm*—Squire, Sanders & Dempsey L.L.P.

(57) ABSTRACT

A stent fixture for supporting a stent during the application of a coating substance is provided.

17 Claims, 4 Drawing Sheets

U.S. PATENT DOCUMENTS

| | | | |
|---|---|---|---|
| 4,762,128 | A | 8/1988 | Rosenbluth |
| 4,798,585 | A | 1/1989 | Inoue et al. |
| 4,800,882 | A | 1/1989 | Gianturco |
| 4,822,535 | A | 4/1989 | Ekman et al. |
| 4,839,055 | A | 6/1989 | Ishizaki et al. |
| 4,846,791 | A | 7/1989 | Hattler et al. |
| 4,865,879 | A | 9/1989 | Finlay |
| 4,882,168 | A | 11/1989 | Casey et al. |
| 4,886,062 | A | 12/1989 | Wiktor |
| 4,893,623 | A | 1/1990 | Rosenbluth |
| 4,906,423 | A | 3/1990 | Frisch |
| 4,931,287 | A | 6/1990 | Bae et al. |
| 4,941,870 | A | 7/1990 | Okada et al. |
| 4,955,899 | A | 9/1990 | Della Corna et al. |
| 4,976,736 | A | 12/1990 | White et al. |
| 4,977,901 | A | 12/1990 | Ofstead |
| 4,992,312 | A | 2/1991 | Frisch |
| 5,017,420 | A | 5/1991 | Marikar |
| 5,019,096 | A | 5/1991 | Fox, Jr. et al. |
| 5,033,405 | A | 7/1991 | Yamada et al. |
| 5,037,392 | A | 8/1991 | Hillstead |
| 5,037,427 | A | 8/1991 | Harada et al. |
| 5,059,211 | A | 10/1991 | Stack et al. |
| 5,095,848 | A | 3/1992 | Ikeno |
| 5,100,992 | A | 3/1992 | Cohn et al. |
| 5,112,457 | A | 5/1992 | Marchant |
| 5,133,742 | A | 7/1992 | Pinchuk |
| 5,163,952 | A | 11/1992 | Froix |
| 5,165,919 | A | 11/1992 | Sasaki et al. |
| 5,171,445 | A | 12/1992 | Zepf |
| 5,188,734 | A | 2/1993 | Zepf |
| 5,201,314 | A | 4/1993 | Bosley et al. |
| 5,219,980 | A | 6/1993 | Swidler |
| 5,229,045 | A | 7/1993 | Soldani |
| 5,234,457 | A | 8/1993 | Andersen |
| 5,242,399 | A | 9/1993 | Lau et al. |
| 5,258,020 | A | 11/1993 | Froix |
| 5,264,246 | A | 11/1993 | Ikeno |
| 5,272,012 | A | 12/1993 | Opolski |
| 5,292,516 | A | 3/1994 | Viegas et al. |
| 5,298,260 | A | 3/1994 | Viegas et al. |
| 5,300,295 | A | 4/1994 | Viegas et al. |
| 5,306,286 | A | 4/1994 | Stack et al. |
| 5,306,501 | A | 4/1994 | Viegas et al. |
| 5,306,786 | A | 4/1994 | Moens et al. |
| 5,308,338 | A | 5/1994 | Helfrich |
| 5,328,471 | A | 7/1994 | Slepian |
| 5,330,768 | A | 7/1994 | Park et al. |
| 5,342,621 | A | 8/1994 | Eury |
| 5,358,740 | A | 10/1994 | Bornside et al. |
| 5,370,684 | A | 12/1994 | Vallana et al. |
| 5,378,511 | A | 1/1995 | Cardinali et al. |
| 5,380,299 | A | 1/1995 | Fearnot et al. |
| 5,417,981 | A | 5/1995 | Endo et al. |
| 5,421,955 | A | 6/1995 | Lau et al. |
| 5,443,496 | A | 8/1995 | Schwartz et al. |
| 5,447,724 | A | 9/1995 | Helmus et al. |
| 5,455,040 | A | 10/1995 | Marchant |
| 5,458,683 | A | 10/1995 | Taylor et al. |
| 5,462,990 | A | 10/1995 | Hubbell et al. |
| 5,464,650 | A | 11/1995 | Berg et al. |
| 5,485,496 | A | 1/1996 | Lee et al. |
| 5,514,154 | A | 5/1996 | Lau et al. |
| 5,516,560 | A | 5/1996 | Harayama et al. |
| 5,516,881 | A | 5/1996 | Lee et al. |
| 5,527,337 | A | 6/1996 | Stack et al. |
| 5,537,729 | A | 7/1996 | Kolobow |
| 5,538,493 | A | 7/1996 | Gerken et al. |
| 5,558,900 | A | 9/1996 | Fan et al. |
| 5,569,295 | A | 10/1996 | Lam |
| 5,569,463 | A | 10/1996 | Helmus et al. |
| 5,578,048 | A | 11/1996 | Pasqualucci et al. |
| 5,578,073 | A | 11/1996 | Haimovich et al. |
| 5,584,877 | A | 12/1996 | Miyake et al. |
| 5,603,721 | A | 2/1997 | Lau et al. |
| 5,605,696 | A | 2/1997 | Eury et al. |
| 5,607,442 | A | 3/1997 | Fischell et al. |
| 5,607,467 | A | 3/1997 | Froix |
| 5,609,629 | A | 3/1997 | Fearnot et al. |
| 5,610,241 | A | 3/1997 | Lee et al. |
| 5,611,775 | A | 3/1997 | Machold et al. |
| 5,616,338 | A | 4/1997 | Fox, Jr. et al. |
| 5,624,411 | A | 4/1997 | Tuch |
| 5,628,730 | A | 5/1997 | Shapland et al. |
| 5,628,786 | A | 5/1997 | Banas et al. |
| 5,637,113 | A | 6/1997 | Tartaglia et al. |
| 5,643,580 | A | 7/1997 | Subramaniam |
| 5,644,020 | A | 7/1997 | Timmermann et al. |
| 5,649,977 | A | 7/1997 | Campbell |
| 5,656,082 | A | 8/1997 | Takatsuki et al. |
| 5,658,995 | A | 8/1997 | Kohn et al. |
| 5,667,767 | A | 9/1997 | Greff et al. |
| 5,670,558 | A | 9/1997 | Onishi et al. |
| 5,674,242 | A | 10/1997 | Phan et al. |
| 5,679,400 | A | 10/1997 | Tuch |
| 5,687,906 | A | 11/1997 | Nakagawa |
| 5,700,286 | A | 12/1997 | Tartaglia et al. |
| 5,702,754 | A | 12/1997 | Zhong |
| 5,707,385 | A | 1/1998 | Williams |
| 5,711,958 | A | 1/1998 | Cohn et al. |
| 5,713,949 | A | 2/1998 | Jayaraman |
| 5,716,981 | A | 2/1998 | Hunter et al. |
| 5,721,131 | A | 2/1998 | Rudolph et al. |
| 5,723,219 | A | 3/1998 | Kolluri et al. |
| 5,735,897 | A | 4/1998 | Buirge |
| 5,741,554 | A | 4/1998 | Tisone |
| 5,746,998 | A | 5/1998 | Torchilin et al. |
| 5,756,553 | A | 5/1998 | Iguchi et al. |
| 5,759,205 | A | 6/1998 | Valentini |
| 5,766,710 | A | 6/1998 | Turnlund et al. |
| 5,769,883 | A | 6/1998 | Buscemi et al. |
| 5,772,864 | A | 6/1998 | Møller et al. |
| 5,776,184 | A | 7/1998 | Tuch |
| 5,783,657 | A | 7/1998 | Pavlin et al. |
| 5,788,626 | A | 8/1998 | Thompson |
| 5,788,979 | A | 8/1998 | Alt et al. |
| 5,800,392 | A | 9/1998 | Racchini |
| 5,820,917 | A | 10/1998 | Tuch |
| 5,823,996 | A | 10/1998 | Sparks |
| 5,824,048 | A | 10/1998 | Tuch |
| 5,824,049 | A | 10/1998 | Ragheb et al. |
| 5,830,178 | A | 11/1998 | Jones et al. |
| 5,833,659 | A | 11/1998 | Kranys |
| 5,836,965 | A | 11/1998 | Jendersee et al. |
| 5,837,008 | A | 11/1998 | Berg et al. |
| 5,837,313 | A | 11/1998 | Ding et al. |
| 5,843,172 | A | 12/1998 | Yan |
| 5,849,859 | A | 12/1998 | Acemoglu |
| 5,851,508 | A | 12/1998 | Greff et al. |
| 5,854,376 | A | 12/1998 | Higashi |
| 5,855,598 | A | 1/1999 | Pinchuk |
| 5,855,600 | A | 1/1999 | Alt |
| 5,855,684 | A | 1/1999 | Bergmann |
| 5,858,746 | A | 1/1999 | Hubbell et al. |
| 5,865,814 | A | 2/1999 | Tuch |
| 5,869,127 | A | 2/1999 | Zhong |
| 5,873,904 | A | 2/1999 | Ragheb et al. |
| 5,876,433 | A | 3/1999 | Lunn |
| 5,877,224 | A | 3/1999 | Brocchini et al. |
| 5,879,713 | A | 3/1999 | Roth et al. |
| 5,891,108 | A | 4/1999 | Leone et al. |
| 5,891,507 | A | 4/1999 | Jayaraman |
| 5,895,407 | A | 4/1999 | Jayaraman |
| 5,897,911 | A | 4/1999 | Loeffler |

5,902,631 A 5/1999 Wang et al.
5,902,875 A 5/1999 Roby et al.
5,905,168 A 5/1999 Dos Santos et al.
5,910,564 A 6/1999 Gruning et al.
5,911,752 A 6/1999 Dustrude et al.
5,914,387 A 6/1999 Roby et al.
5,919,893 A 7/1999 Roby et al.
5,922,393 A 7/1999 Jayaraman
5,925,720 A 7/1999 Kataoka et al.
5,928,279 A 7/1999 Shannon et al.
5,932,299 A 8/1999 Katoot
5,935,135 A 8/1999 Bramfitt et al.
5,948,018 A 9/1999 Dereume et al.
5,955,509 A 9/1999 Webber et al.
5,958,385 A 9/1999 Tondeur et al.
5,962,138 A 10/1999 Kolluri et al.
5,968,091 A 10/1999 Pinchuk et al.
5,971,954 A 10/1999 Conway et al.
5,972,027 A 10/1999 Johnson
5,980,928 A 11/1999 Terry
5,980,972 A 11/1999 Ding
5,984,449 A 11/1999 Tajika et al.
5,997,517 A 12/1999 Whitbourne
6,010,530 A 1/2000 Goicoechea
6,010,573 A 1/2000 Bowlin
6,011,125 A 1/2000 Lohmeijer et al.
6,013,099 A 1/2000 Dinh et al.
6,015,541 A 1/2000 Greff et al.
6,030,371 A 2/2000 Pursley
6,033,582 A 3/2000 Lee et al.
6,034,204 A 3/2000 Mohr et al.
6,042,875 A 3/2000 Ding et al.
6,045,899 A 4/2000 Wang et al.
6,051,576 A 4/2000 Ashton et al.
6,051,648 A 4/2000 Rhee et al.
6,054,553 A 4/2000 Groth et al.
6,056,993 A 5/2000 Leidner et al.
6,059,714 A 5/2000 Armini et al.
6,060,451 A 5/2000 DiMaio et al.
6,060,518 A 5/2000 Kabanov et al.
6,068,202 A 5/2000 Hynes et al.
6,071,305 A 6/2000 Brown et al.
6,080,488 A 6/2000 Hostettler et al.
6,096,070 A 8/2000 Ragheb et al.
6,099,562 A 8/2000 Ding et al.
6,106,889 A 8/2000 Jayaraman
6,110,188 A 8/2000 Narciso, Jr.
6,110,483 A 8/2000 Whitbourne et al.
6,113,629 A 9/2000 Ken
6,120,491 A 9/2000 Kohn et al.
6,120,536 A 9/2000 Ding et al.
6,120,788 A 9/2000 Barrows
6,120,847 A 9/2000 Yang et al.
6,120,904 A 9/2000 Hostettler et al.
6,121,027 A 9/2000 Clapper et al.
6,126,686 A 10/2000 Badylak et al.
6,129,755 A 10/2000 Mathis et al.
6,129,761 A 10/2000 Hubbell
6,136,333 A 10/2000 Cohn et al.
6,140,127 A 10/2000 Sprague
6,140,431 A 10/2000 Kinker et al.
6,143,354 A 11/2000 Koulik et al.
6,143,370 A 11/2000 Panagiotou et al.
6,153,252 A 11/2000 Hossainy et al.
6,156,373 A 12/2000 Zhong et al.
6,159,978 A 12/2000 Myers et al.
6,165,212 A 12/2000 Dereume et al.
6,165,267 A 12/2000 Torczynski
6,171,334 B1 1/2001 Cox
6,172,167 B1 1/2001 Stapert et al.
6,174,329 B1 1/2001 Callol et al.
6,177,523 B1 1/2001 Reich et al.
6,180,632 B1 1/2001 Myers et al.
6,194,034 B1 2/2001 Nishi et al.
6,197,013 B1 3/2001 Reed et al.
6,203,551 B1 3/2001 Wu
6,203,569 B1 3/2001 Wijay
6,206,915 B1 3/2001 Fagan et al.
6,211,249 B1 4/2001 Cohn et al.
6,214,115 B1 4/2001 Taylor et al.
6,214,901 B1 4/2001 Chudzik et al.
6,228,072 B1 5/2001 Omaleki et al.
6,231,600 B1 5/2001 Zhong
6,235,340 B1 5/2001 Lee et al.
6,240,616 B1 6/2001 Yan
6,244,575 B1 6/2001 Vaartstra et al.
6,245,099 B1 6/2001 Edwin et al.
6,245,753 B1 6/2001 Byun et al.
6,245,760 B1 6/2001 He et al.
6,248,129 B1 6/2001 Froix
6,248,398 B1 6/2001 Talieh et al.
6,251,136 B1 6/2001 Guruwaiya et al.
6,254,632 B1 7/2001 Wu et al.
6,258,121 B1 7/2001 Yang et al.
6,258,371 B1 7/2001 Koulik et al.
6,261,320 B1 7/2001 Tam et al.
6,262,034 B1 7/2001 Mathiowitz et al.
6,270,504 B1 8/2001 Lorentzen Cornelius et al.
6,270,788 B1 8/2001 Koulik et al.
6,273,878 B1 8/2001 Muni
6,273,908 B1 8/2001 Ndondo-Lay
6,273,910 B1 8/2001 Limon
6,273,913 B1 8/2001 Wright et al.
6,277,449 B1 8/2001 Kolluri et al.
6,279,368 B1 8/2001 Escano et al.
6,283,947 B1 9/2001 Mirzaee
6,283,949 B1 9/2001 Roorda
6,284,305 B1 9/2001 Ding et al.
6,287,249 B1 9/2001 Tam et al.
6,287,628 B1 9/2001 Hossainy et al.
6,299,604 B1 10/2001 Ragheb et al.
6,306,165 B1 10/2001 Patnaik et al.
6,306,176 B1 10/2001 Whitbourne
6,322,847 B1 11/2001 Zhong et al.
6,331,191 B1 12/2001 Chobotov
6,331,313 B1 12/2001 Wong et al.
4,733,665 C2 1/2002 Palmaz
6,335,029 B1 1/2002 Kamath et al.
6,344,035 B1 2/2002 Chudzik et al.
6,346,110 B2 2/2002 Wu
6,358,556 B1 3/2002 Ding et al.
6,358,567 B2 3/2002 Pham et al.
6,364,903 B2 4/2002 Tseng et al.
6,368,658 B1 4/2002 Schwarz et al.
6,372,283 B1 4/2002 Shim et al.
6,379,381 B1 4/2002 Hossainy et al.
6,383,215 B1 5/2002 Sass
6,387,118 B1 5/2002 Hanson
6,387,379 B1 5/2002 Goldberg et al.
6,395,326 B1 5/2002 Castro et al.
6,407,009 B1 6/2002 You et al.
6,416,543 B1 7/2002 Hilaire et al.
6,419,692 B1 7/2002 Yang et al.
6,435,798 B1 8/2002 Satoh
6,440,221 B2 8/2002 Shamouilian et al.
6,451,373 B1 9/2002 Hossainy et al.
6,475,779 B2 11/2002 Mathiowitz et al.
6,482,834 B2 11/2002 Spada et al.
6,494,862 B1 12/2002 Ray et al.
6,503,538 B1 1/2003 Chu et al.
6,503,556 B2 1/2003 Harish et al.
6,503,954 B1 1/2003 Bhat et al.
6,506,437 B1 1/2003 Harish et al.
6,517,534 B1 2/2003 McGovern et al.
6,517,889 B1 2/2003 Jayaraman
6,521,284 B1 2/2003 Parsons et al.

6,524,347 B1 2/2003 Myers et al.
6,527,801 B1 3/2003 Dutta
6,527,863 B1 3/2003 Pacetti et al.
6,528,526 B1 3/2003 Myers et al.
6,530,950 B1 3/2003 Alvarado et al.
6,530,951 B1 3/2003 Bates et al.
6,534,112 B1 3/2003 Bouchier et al.
6,540,776 B2 4/2003 Sanders Millare et al.
6,544,223 B1 4/2003 Kokish
6,544,543 B1 4/2003 Mandrusov et al.
6,544,582 B1 4/2003 Yoe
6,555,157 B1 4/2003 Hossainy
6,558,733 B1 5/2003 Hossainy et al.
6,562,136 B1 5/2003 Chappa et al.
6,565,659 B1 5/2003 Pacetti et al.
6,572,644 B1 6/2003 Moein
6,572,651 B1 6/2003 De Scheerder et al.
6,575,933 B1 6/2003 Wittenberger et al.
6,585,755 B2 7/2003 Jackson et al.
6,585,765 B1 7/2003 Hossainy et al.
6,585,926 B1 7/2003 Mirzaee
6,605,154 B1 8/2003 Villareal
6,610,087 B1 8/2003 Zarbatany et al.
6,613,432 B2 9/2003 Zamora et al.
6,616,765 B1 9/2003 Hossaony et al.
6,620,617 B2 9/2003 Mathiowitz et al.
6,623,448 B2 9/2003 Slater
6,625,486 B2 9/2003 Lundkvist et al.
6,641,611 B2 11/2003 Jayaraman
6,645,135 B1 11/2003 Bhat
6,645,195 B1 11/2003 Bhat et al.
6,656,216 B1 12/2003 Hossainy et al.
6,656,506 B1 12/2003 Wu et al.
6,660,034 B1 12/2003 Mandrusov et al.
6,663,662 B2 12/2003 Pacetti et al.
6,663,880 B1 12/2003 Roorda et al.
6,666,880 B1 12/2003 Chiu et al.
6,673,154 B1 1/2004 Pacetti et al.
6,673,385 B1 1/2004 Ding et al.
6,676,700 B1 1/2004 Jacobs et al.
6,682,771 B2 1/2004 Zhong et al.
6,689,099 B2 2/2004 Mirzaee
6,689,350 B2 2/2004 Uhrich
6,695,920 B1 2/2004 Pacetti et al.
6,706,013 B1 3/2004 Bhat et al.
6,709,514 B1 3/2004 Hossainy
6,712,845 B2 3/2004 Hossainy
6,713,119 B2 3/2004 Hossainy et al.
6,716,444 B1 4/2004 Castro et al.
6,723,120 B2 4/2004 Yan
6,723,373 B1 4/2004 Narayanan et al.
6,730,064 B2 5/2004 Ragheb et al.
6,733,768 B2 5/2004 Hossainy et al.
6,740,040 B1 5/2004 Mandrusov et al.
6,743,462 B1 6/2004 Pacetti
6,746,773 B2 6/2004 Llanos et al.
6,749,626 B1 6/2004 Bhat et al.
6,753,071 B1 6/2004 Pacetti
6,758,859 B1 7/2004 Dang et al.
6,759,054 B2 7/2004 Chen et al.
6,764,505 B1 7/2004 Hossainy et al.
6,776,796 B2 8/2004 Falotico et al.
6,780,424 B2 8/2004 Claude
6,790,228 B2 9/2004 Hossainy et al.
6,818,063 B1 11/2004 Kerrigan
6,824,559 B2 11/2004 Michal
6,860,946 B2 3/2005 Hossainy et al.
6,887,510 B2 5/2005 Villareal
6,890,583 B2 5/2005 Chudzik et al.
6,955,723 B2 10/2005 Pacetti et al.
6,972,054 B2 12/2005 Kerrigan
7,074,276 B1 7/2006 Van Sciver et al.
7,175,874 B1 2/2007 Pacetti
7,323,209 B1 1/2008 Esbeck et al.
7,335,265 B1 2/2008 Hossainy
7,335,391 B1 2/2008 Pacetti
7,354,480 B1 4/2008 Kokish et al.
7,404,979 B1 7/2008 Pacetti
2001/0007083 A1 7/2001 Roorda
2001/0029351 A1 10/2001 Falotico et al.
2001/0037145 A1 11/2001 Guruwaiya et al.
2002/0005206 A1 1/2002 Falotico et al.
2002/0007213 A1 1/2002 Falotico et al.
2002/0007214 A1 1/2002 Falotico
2002/0007215 A1 1/2002 Falotico et al.
2002/0050220 A1 5/2002 Schueller et al.
2002/0051730 A1 5/2002 Bodnar et al.
2002/0065548 A1* 5/2002 Birdsall et al. ..... 623/1.15
2002/0077693 A1 6/2002 Barclay et al.
2002/0082679 A1 6/2002 Sirhan et al.
2002/0087123 A1 7/2002 Hossainy et al.
2002/0091433 A1 7/2002 Ding et al.
2002/0111590 A1 8/2002 Davila et al.
2002/0165608 A1 11/2002 Llanos et al.
2002/0176849 A1 11/2002 Slepian
2002/0183581 A1 12/2002 Yoe et al.
2002/0188037 A1 12/2002 Chudzik et al.
2002/0188277 A1 12/2002 Roorda et al.
2003/0004141 A1 1/2003 Brown
2003/0028243 A1 2/2003 Bates et al.
2003/0028244 A1 2/2003 Bates et al.
2003/0031780 A1 2/2003 Chudzik et al.
2003/0032767 A1 2/2003 Tada et al.
2003/0036794 A1 2/2003 Ragheb et al.
2003/0039689 A1 2/2003 Chen et al.
2003/0040712 A1 2/2003 Ray et al.
2003/0040790 A1 2/2003 Furst
2003/0059520 A1 3/2003 Chen et al.
2003/0060877 A1 3/2003 Falotico et al.
2003/0065377 A1 4/2003 Davila et al.
2003/0072868 A1 4/2003 Harish et al.
2003/0073961 A1 4/2003 Happ
2003/0083646 A1 5/2003 Sirhan et al.
2003/0083739 A1 5/2003 Cafferata
2003/0088307 A1 5/2003 Shulze et al.
2003/0097088 A1 5/2003 Pacetti
2003/0097173 A1 5/2003 Dutta
2003/0105518 A1 6/2003 Dutta
2003/0113439 A1 6/2003 Pacetti et al.
2003/0150380 A1 8/2003 Yoe
2003/0158517 A1 8/2003 Kokish
2003/0190406 A1 10/2003 Hossainy et al.
2003/0211230 A1 11/2003 Pacetti et al.
2003/0215564 A1 11/2003 Heller et al.
2004/0018296 A1 1/2004 Castro et al.
2004/0029952 A1 2/2004 Chen et al.
2004/0047978 A1 3/2004 Hossainy et al.
2004/0047980 A1 3/2004 Pacetti et al.
2004/0052858 A1 3/2004 Wu et al.
2004/0052859 A1 3/2004 Wu et al.
2004/0054104 A1 3/2004 Pacetti
2004/0060508 A1 4/2004 Pacetti et al.
2004/0062853 A1 4/2004 Pacetti et al.
2004/0063805 A1 4/2004 Pacetti et al.
2004/0071861 A1 4/2004 Mandrusov et al.
2004/0072922 A1 4/2004 Hossainy et al.
2004/0073298 A1 4/2004 Hossainy
2004/0086542 A1 5/2004 Hossainy et al.
2004/0086550 A1 5/2004 Roorda et al.
2004/0096504 A1 5/2004 Michal
2004/0098117 A1 5/2004 Hossainy et al.
2004/0182312 A1 9/2004 Pacetti
2004/0191405 A1 9/2004 Kerrigan
2004/0213893 A1 10/2004 Boulais
2005/0069630 A1 3/2005 Fox et al.
2005/0074544 A1 4/2005 Pacetti et al.

2005/0261764 A1 11/2005 Pacetti et al.

FOREIGN PATENT DOCUMENTS

| | | |
|---|---|---|
| EP | 0 301 856 | 2/1989 |
| EP | 0 396 429 | 11/1990 |
| EP | 0 514 406 | 11/1992 |
| EP | 0 604 022 | 6/1994 |
| EP | 0 623 354 | 11/1994 |
| EP | 0 627 226 | 12/1994 |
| EP | 0 665 023 | 8/1995 |
| EP | 0 701 802 | 3/1996 |
| EP | 0 716 836 | 6/1996 |
| EP | 0 850 651 | 7/1996 |
| EP | 0 809 999 | 12/1997 |
| EP | 0 832 655 | 4/1998 |
| EP | 0 875 218 | 11/1998 |
| EP | 0 879 595 | 11/1998 |
| EP | 0 897 701 | 2/1999 |
| EP | 0 910 584 | 4/1999 |
| EP | 0 923 953 | 6/1999 |
| EP | 0 953 320 | 11/1999 |
| EP | 0 970 711 | 1/2000 |
| EP | 0 982 041 | 3/2000 |
| EP | 1 023 879 | 8/2000 |
| EP | 1 192 957 | 4/2002 |
| EP | 1 273 314 | 1/2003 |
| JP | 05009726 A | 1/1993 |
| JP | 11299901 | 11/1999 |
| JP | 2001-190687 | 7/2001 |
| SU | 872531 | 10/1981 |
| SU | 876663 | 10/1981 |
| SU | 905228 | 2/1982 |
| SU | 790725 | 2/1983 |
| SU | 1016314 | 5/1983 |
| SU | 811750 | 9/1983 |
| SU | 1293518 | 2/1987 |
| WO | WO 90/01969 | 3/1990 |
| WO | WO 91/12846 | 9/1991 |
| WO | WO 94/09760 | 5/1994 |
| WO | WO 95/10989 | 4/1995 |
| WO | WO 95/24929 | 9/1995 |
| WO | WO 96/40174 | 12/1996 |
| WO | WO 97/10011 | 3/1997 |
| WO | WO 97/45105 | 12/1997 |
| WO | WO 97/46590 | 12/1997 |
| WO | WO 98/08463 | 3/1998 |
| WO | WO 98/17331 | 4/1998 |
| WO | WO 98/23228 | 6/1998 |
| WO | WO 98/32398 | 6/1998 |
| WO | WO 98/36784 | 8/1998 |
| WO | WO 99/01118 | 1/1999 |
| WO | WO 99/16386 | 4/1999 |
| WO | WO 99/38546 | 8/1999 |
| WO | WO 99/63981 | 12/1999 |
| WO | WO 00/02599 | 1/2000 |
| WO | WO 00/12147 | 3/2000 |
| WO | WO 00/18446 | 4/2000 |
| WO | WO 00/64506 | 11/2000 |
| WO | WO 01/00112 | 1/2001 |
| WO | WO 01/01890 | 1/2001 |
| WO | WO 01/15751 | 3/2001 |
| WO | WO 01/17577 | 3/2001 |
| WO | WO 01/45763 | 6/2001 |
| WO | WO 01/49338 | 7/2001 |
| WO | WO 01/51027 | 7/2001 |
| WO | WO 01/52772 | 7/2001 |
| WO | WO 01/74414 | 10/2001 |
| WO | WO 01/91918 | 12/2001 |
| WO | WO 02/03890 | 1/2002 |
| WO | WO 02/26162 | 4/2002 |
| WO | WO 02/34311 | 5/2002 |
| WO | WO 02/056790 | 7/2002 |
| WO | WO 02/058753 | 8/2002 |
| WO | WO 02/102283 | 12/2002 |
| WO | WO 03/000308 | 1/2003 |
| WO | WO 03/022323 | 3/2003 |
| WO | WO 03/028780 | 4/2003 |
| WO | WO 03/037223 | 5/2003 |
| WO | WO 03/039612 | 5/2003 |
| WO | WO 03/080147 | 10/2003 |
| WO | WO 03/082368 | 10/2003 |
| WO | WO 04/000383 | 12/2003 |
| WO | WO 2004/009145 | 1/2004 |

OTHER PUBLICATIONS

Anonymous, *Heparin-coated stents cut complications by 30%*, Clinica 732:17 (Nov. 18, 1996), http://www.dialogweb.com/cgi/document?req=1061847871753, printed Aug. 25, 2003 (2 pages).

Anonymous, *Rolling Therapeutic Agent Loading Device for Therapeutic Agent Delivery or Coated Stent* (Abstract 434009), Res. Disclos. pp. 974-975 (Jun. 2000).

Anonymous, *Stenting continues to dominate cardiology*, Clinica 720:22 (Sep. 2, 1996), http://www.dialogweb.com/cgi/document?reg=1061848017752, printed Aug. 25, 2003 (2 pages).

Aoyagi et al., *Preparation of cross-linked aliphatic polyester and application to thermo-responsive material*, Journal of Controlled Release 32:87-96 (1994).

Barath et al., *Low Dose of Antitumor Agents Prevents Smooth Muscle Cell Proliferation After Endothelial Injury*, JACC 13(2): 252A (Abstract) (Feb. 1989).

Barbucci et al., *Coating of commercially available materials with a new heparinizable material*, J. Biomed. Mater. Res. 25:1259-1274 (Oct. 1991).

Chung et al., *Inner core segment design for drug delivery control of thermo-responsive polymeric micelles*, Journal of Controlled Release 65:93-103 (2000).

Coating Techniques, *Air Knife Coating*, http://www.ferron-magnetic.co.uk/coatings/airknife.htm, 1 page, printed Jul. 1, 2003.

Coating Techniques, *Gap Coating*, http://www.ferron-magnetic.co.uk/coatings/knife.htm, 1 page, printed Jul. 1, 2003.

Coating Techniques, *Gravure Coating*, http://www.ferron-magnetic.co.uk/coatings/gravure.htm, 2 pages, printed Jul. 1, 2003.

Coating Techniques, *Reverse Roll Coating*, http://www.ferron-magnetic.co.uk/coatinqs/revroll.htm, 2 pages, printed Jul. 1, 2003.

Dev et al., *Kinetics of Drug Delivery to the Arterial Wall Via Polyurethane-Coated Removable Nitinol Stent: Comparative Study of Two Drugs*, Catheterization and Cardiovascular Diagnosis 34:272-278 (1995).

Dichek et al., *Seeding of Intravascular Stents with Genetically Engineered Endothelial Cells*, Circ. 80(5):1347-1353 (Nov. 1989).

Eigler et al., *Local Arterial Wall Drug Delivery from a Polymer Coated Removable Metallic Stent: Kinetics, Distribution, and Bioactivity of Forskolin*, JACC, 4A (701-1), Abstract (Feb. 1994).

Forester et al., *A Paradigm for Restenosis Based on Cell Biology: Clues for the Development of New Preventive Therapies*; J. Am. Coll. Cardio. 1991; 17:758-769.

Helmus, *Overview of Biomedical Materials*, MRS Bulletin, pp. 33-38 (Sep. 1991).

Herdeg et al., *Antiproliferative Stent Coatings: Taxol and Related Compounds*, Semin. Intervent. Cardiol. 3:197-199 (1998).

Huang et al., *Biodegradable Polymers Derived from Aminoacids*, Macromol. Symp. 144, 7-32 (1999).

Illbruck Sealant Systems, *Application: Window and Perimeter Silicone*, http://www.willseal.com/usa/produktuebersicht/dichtstoffe/perwindow/verleqe_anleitung . . . , printed Nov. 29, 2004 (3 pages).

Inoue et al., *An AB block copolymer of oligo(methyl methacrylate) and poly(acrylic acid) for micellar delivery of hydrophobic drugs*, Journal of Controlled Release 51:221-229 (1998).

*International Search Report and Written Opinion*, dated Mar. 1, 2005 for PCT Application No. PCT/US2004/031185, filed Sep. 22, 2004 (14 pages).

Kataoka et al., *Block copolymer micelles as vehicles for drug delivery*, Journal of Controlled Release 24:119-132 (1993).

Kim, *Solid State Sintering*, AMSE 604 Solid State Reactions and Sintering, Electroceramic laboratory in Dept. of Materials Science & Engineering, POSTECH, Pohang University of Science and Technology (20 pages).
Levy et al., *Strategies for Treating Arterial Restenosis Using Polymeric Controlled Release Implants*, Biotechnol. Bioact. Polym. [Proc. Am. Chem. Soc. Symp.], pp. 259-268 (1994).
Liu et al., *Drug release characteristics of unimolecular polymeric micelles*, Journal of Controlled Release 68:167-174 (2000).
Marconi et al., *Covalent bonding of heparin to a vinyl copolymer for biomedical applications*, Biomaterials 18(12):885-890 (1997).
Matsumaru et al., *Embolic Materials for Endovascular Treatment of Cerebral Lesions*, J. Biomater. Sci. Polymer Edn 8(7):555-569 (1997).
Miyazaki et al., *Antitumor Effect of Implanted Ethylene-Vinyl Alcohol Copolymer Matrices Containing Anticancer Agents on Ehrlich Ascites Carcinoma and P388 Leukemia in Mice*, Chem. Pharm. Bull. 33(6) 2490-2498 (1985).
Miyazawa et al., *Effects of Pemirolast and Tranilast on Intimal Thickening After Arterial Injury in the Rat*, J. Cardiovasc. Pharmacol., pp. 157-162 (1997).
Nordrehaug et al., *A novel biocompatible coating applied to coronary stents*, European Heart Journal 14, p. 321 (P1694), Abstr. Suppl. (1993).
Ohsawa et al., *Preventive Effects of an Antiallergic Drug, Pemirolast Potassium, on Restenosis After Percutaneous Transluminal Coronary Angioplasty*, American Heart Journal 136(6):1081-1087 (Dec. 1998).
Ozaki et al., *New Stent Technologies*, Progress in Cardiovascular Diseases, vol. XXXIX(2):129-140 (Sep./Oct. 1996).
Pechar et al., *Poly(ethylene glycol) Multiblock Copolymer as a Carrier of Anti-Cancer Drug Doxorubicin*, Bioconjucate Chemistry 11(2):131-139 (Mar./Apr. 2000).
Peng et al., *Role of polymers in improving the results of stenting in coronary arteries*, Biomaterials 17:685-694 (1996).
Saotome, et al., *Novel Enzymatically Degradable Polymers Comprising α-Amino Acid, 1,2-Ethanediol, and Adipic Acid*, Chemistry Letters, pp. 21-24, (1991).
Shigeno, *Prevention of Cerebrovascular Spasm by Bosentan, Novel Endothelin Receptor*; Chemical Abstract 125:212307 (1996).
van Beusekom et al., *Coronary stent coatings*, Coronary Artery Disease 5(7):590-596 (Jul. 1994).
Van Iseghem, *Important Concepts on Coating Plastics From a Formulator's Perspective*, Modern Paint and Coatings, pp. 30-38 (Feb. 1998).
Wilensky et al., *Methods and Devices for Local Drug Delivery in Coronary and Peripheral Arteries*, Trends Cardiovasc. Med. 3(5):163-170 (1993).
Yokoyama et al., *Characterization of physical entrapment and chemical conjugation of adriamycin in polymeric micelles and their design for in vivo delivery to a solid tumor*, Journal of Controlled Release 50:79-92 (1998).
U.S. Appl. No. 10/040,538, filed Dec. 28, 2001, Pacetti et al.
U.S. Appl. No. 10/255,913, filed Sep. 26, 2002, Tang et al.
U.S. Appl. No. 10/304,669, filed Nov. 25, 2002, Madriaga et al.
U.S. Appl. No. 10/330,412, filed Dec. 27, 2002, Hossainy et al.
U.S. Appl. No. 10/750,312, filed Dec. 30, 2003, Desnoyer et al.
U.S. Appl. No. 10/805,047, filed Mar. 18, 2004, Yip et al.

* cited by examiner

STENT FIXTURE HAVING ROUNDED SUPPORT STRUCTURES AND METHOD FOR USE THEREOF

TECHNICAL FIELD

This invention relates generally to stent fixtures, and more particularly, but not exclusively, provides a stent mandrel having spherical support structures and method for use thereof that reduce coating defects on stents.

BACKGROUND

Blood vessel occlusions are commonly treated by mechanically enhancing blood flow in the affected vessels, such as by employing a stent. Stents act as scaffoldings, functioning to physically hold open and, if desired, to expand the wall of affected vessels. Typically stents are capable of being compressed, so that they can be inserted through small lumens via catheters, and then expanded to a larger diameter once they are at the desired location. Examples in the patent literature disclosing stents include U.S. Pat. No. 4,733,665 issued to Palmaz, U.S. Pat. No. 4,800,882 issued to Gianturco, and U.S. Pat. No. 4,886,062 issued to Wiktor.

FIG. 1 illustrates a conventional stent 10 formed from a plurality of struts 12. The plurality of struts 12 are radially expandable and interconnected by connecting elements 14 that are disposed between the adjacent struts 12, leaving lateral openings or gaps 16 between the adjacent struts 12. The struts 12 and the connecting elements 14 define a tubular stent body having an outer, tissue-contacting surface and an inner surface.

Stents are used not only for mechanical intervention but also as vehicles for providing biological therapy. Biological therapy can be achieved by medicating the stents. Medicated stents provide for the local administration of a therapeutic substance at the diseased site. Local delivery of a therapeutic substance is a preferred method of treatment because the substance is concentrated at a specific site and thus smaller total levels of medication can be administered in comparison to systemic dosages that often produce adverse or even toxic side effects for the patient.

One method of medicating a stent involves the use of a polymeric carrier coated onto the surface of the stent. A composition including a solvent, a polymer dissolved in the solvent, and a therapeutic substance dispersed in the blend is applied to the stent by immersing the stent in the composition or by spraying the composition onto the stent. The solvent is allowed to evaporate, leaving on the stent strut surfaces a coating of the polymer and the therapeutic substance impregnated in the polymer.

A shortcoming of the above-described method of medicating a stent is the potential for coating defects. While some coating defects can be minimized by adjusting the coating parameters, other defects occur due to the nature of the interface between the stent and the apparatus on which the stent is supported during the coating process. A high degree of surface contact between the stent and the supporting apparatus can provide regions in which the liquid composition can flow, wick, and collect as the composition is applied. As the solvent evaporates, the excess composition hardens to form excess coating at and around the contact points between the stent and the supporting apparatus. Upon the removal of the coated stent from the supporting apparatus, the excess coating may stick to the apparatus, thereby removing some of the coating from the stent and leaving bare areas. Alternatively, the excess coating may stick to the stent, thereby leaving excess coating as clumps or pools on the struts or webbing between the struts.

Accordingly, a new stent and method of use are needed to minimize coating defects.

SUMMARY

A stent fixture for supporting a stent during a coating process is provided comprising a member for being inserted at least partially into a longitudinal bore of a stent, the member having at least one spherical component for making contact with the stent. The fixture can additionally comprise a second member coupled to one end of the member and a third member coupled to the other end of the member. The second and third members can be in constant contact with the stent during the coating process. In some embodiments, the second and third member can be in interim contact with the stent during the coating process. In some embodiments, the stent is capable of moving back and forth between the second and third members during the coating process.

In some embodiments, the spherical component penetrates through a gap between struts of the stent such that a surface of the spherical component project out from an outer surface of the stent. In some embodiments, the spherical component penetrates at least minimally through a gap between struts of the stent such that the surface of the spherical component does not project out from an outer surface of the stent. The spherical component can prevent the member from making contact with the stent. The spherical component can be moved incrementally with respect to the member for repositioning of the spherical component on the member.

In accordance with another aspect of the invention, methods of coating a stent using the above-described fixtures are provided.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION

The following description is provided to enable any person having ordinary skill in the art to make and use the invention, and is provided in the context of a particular application and its requirements. Various modifications to the embodiments will be readily apparent to those skilled in the art, and the generic principles defined herein may be applied to other embodiments and applications without departing from the spirit and scope of the invention. Thus, the present invention is not intended to be limited to the embodiments shown, but is to be accorded the widest scope consistent with the principles, features and teachings disclosed herein.

Figure 1:
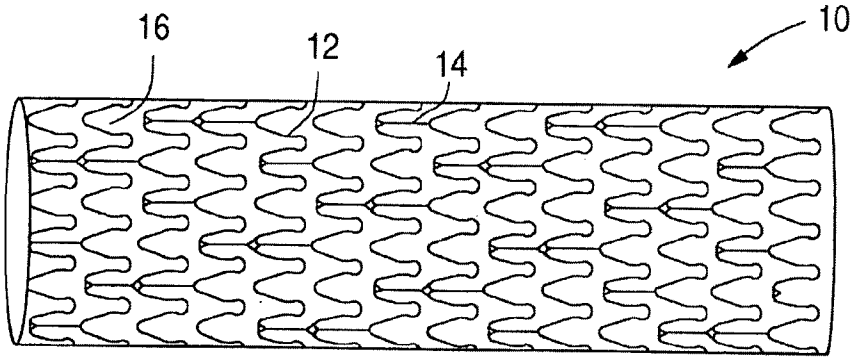
FIG. 1 Prior Art
FIG. 1 is a diagram illustrating a conventional stent.
Figure 2:
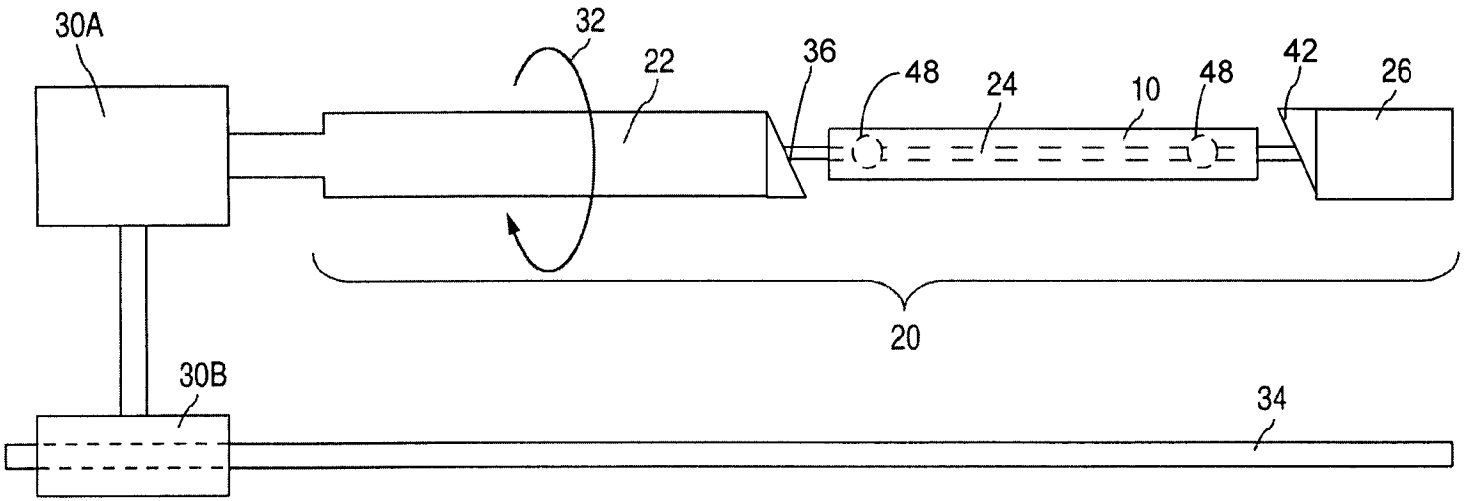
FIG. 2 is a diagram illustrating a stent fixture in accordance with an embodiment of the invention.

FIG. 2 illustrates a stent fixture 20 in accordance with an embodiment of the invention. The fixture 20 for supporting the stent 10 is illustrated to include a support member 22, a mandrel 24, and a lock member 26. The support member 22 can connect to a motor 30A so as to provide rotational motion about the longitudinal axis of the stent 10, as depicted by arrow 32, during a coating process (which can include spraying and/or drying such as by application of a gas). Another motor 30B can also be provided for moving the support member 22 in a linear direction, back and forth, along a rail 34.

Figure 3:
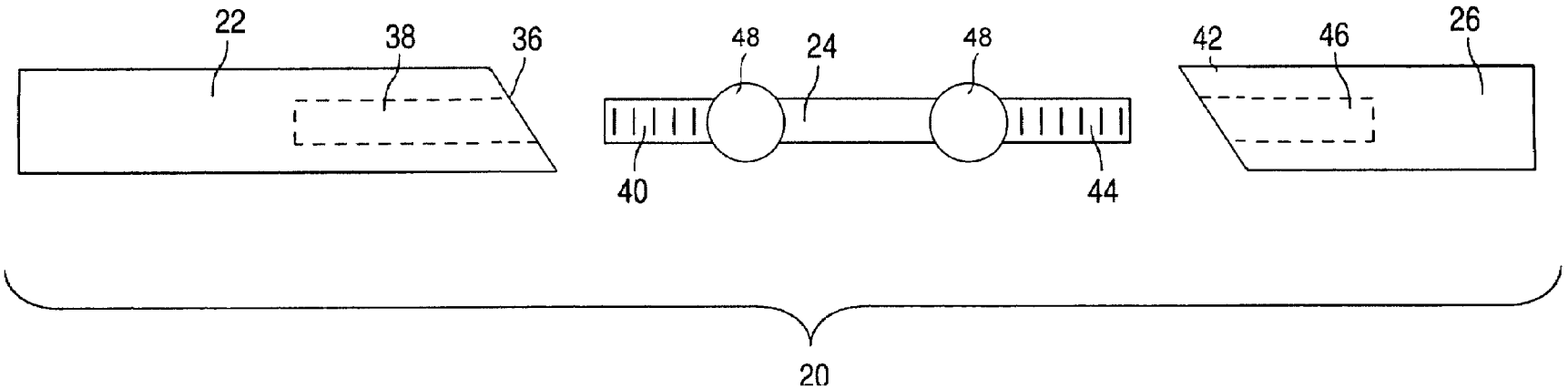
FIG. 3 is a diagram illustrating an expanded view of stent fixture of FIG. 2.

FIG. 3 illustrates an expanded view of the stent fixture 20. The support member 22 can include a slanted end 36, slanting at an angle $\phi_1$ of about 15° to about 75°, more narrowly from about 30° to about 60°. By way of example, angle $\phi_1$ can be about 45°. In some embodiments the slanted end 36 is in constant contact with its respective end of the stent 10 during the coating process. In some embodiments, the stent 10 can moved back and forth during the coating process with respect to the mandrel 24 so as to provide interim contact with the slanted end 36. In yet other embodiments, the stent 10 does not contact the slanted end 36 during the coating process. In some embodiments, the size of the slanted end 36 should be large enough so as to prevent the slanted end 36 from penetrating into the longitudinal bore of the stent 10—as positioned on the fixture 20. Since the stent 10 can vary in size, when referring to the inner/outer diameter of the stent 10, unless otherwise specifically stated, the measurement is as positioned on the fixture. In accordance with one embodiment of the invention, the mandrel 24 can be permanently affixed to the slanted end 36. Alternatively, the support member 22 can include a bore 38 for receiving a first end 40 of the mandrel 24. The first end 40 of the mandrel 24 can be threaded to screw into the bore 38 or, alternatively, can be retained within the bore 38 by a friction fit. The bore 38 should be deep enough so as to allow the mandrel 24 to securely mate with the support member 22. The depth of the bore 38 can also be over-extended so as to allow a significant length of the mandrel 24 to penetrate or screw into the bore 38. The bore 38 can also extend completely through the support member 22. This would allow the length of the mandrel 24 to be adjusted to accommodate stents of various sizes.

The outer diameter of the mandrel 24 can be smaller than the inner diameter of the stent 10 so as to prevent the outer surface of the mandrel 24 from making contact with the inner surface of the stent 10. A sufficient clearance between the outer surface of the mandrel 24 and the inner surface of the stent 10 should be provided to prevent the mandrel 24 from obstructing the pattern of the stent body during the coating process. By way of example, the outer diameter of the mandrel 24 can be from about 0.010 inches (0.254 mm) to about 0.017 inches (0.432 mm) when the stent 10 has an inner diameter of between about 0.025 inches (0.635 mm) and about 0.035 inches (0.889 mm) when mounted on the fixture 20. The mandrel 24 should be longer than the stent 10 mounted thereon.

The mandrel 24 has at least one sphere 48 disposed thereon (e.g., at the middle of the stent 10) so as to prevent or minimize stent/mandrel contact. In an embodiment of the invention, the mandrel 24 has two spheres 48, each located adjacent to an end region of the mandrel 24. In some embodiments, the spheres 48 and the mandrel 24 are concentered about the same axis of rotation such that a longitudinal center axis of the mandrel 24 runs through the center of the spheres 48. Alternatively, the spheres 48 can be shifted with respect to the mandrel 24 such that the center axis of rotation of the mandrel 24 is off-set from the axis of rotation of the spheres 48.

In an embodiment of the invention, the spheres 48 can have a diameter up to about 90% of the stent 10 inner diameter, e.g., up to about 0.0225 inches for a stent having an inner diameter of 0.025 inches when mounted on the fixture 20. In some embodiments the diameter of the spheres 48 is large enough such that a surface of the spheres 48 does not extend out from an outer surface of the stent 10 through the gap regions 16. Accordingly, a segment of the spheres 48 will be placed inset the gapped region 16, without protruding out from the surface of the stent 10. In some embodiments, the diameter of the spheres 48 is small enough that at least a portion of the spheres 48 extends out through the gap 16 and above an outer surface of the stent 10. In either embodiment, the spheres 48 should function in part to prevent or minimize stent/mandrel contact.

The spheres 48 can be integral with the mandrel 24, e.g., the mandrel 24 and the spheres 48 could be formed from a single mold, or the spheres 48 can be coupled to the mandrel 24. In some embodiments, the positioning of the spheres 48 is adjustable with respect to the mandrel 24. In some embodiments, the spheres 48 can be incrementally moved with respect to the mandrel 24. Accordingly, the mandrel 24 and sphere 48 combination should include means for allowing the spheres 48 to be moved incrementally with respect to the mandrel 24 such as a thread/screw type assembly, a teeth/lock engagement or the like.

The lock member 26 includes a slanted end 42 having a slanted angle $\phi_2$. Angle $\phi_2$ can be the same as or different than the above-described angle $\phi_1$. As best illustrated by the figures, the slanted end 42 can slant in an opposing direction to the slanted end 36. As a result, when the surface of the slanted end 36 is facing a spray nozzle or a gas nozzle, the surface of the slanted end 42 is facing away from the nozzle. Should the spacing between the slanted ends 36 and 42 be larger than the length of the stent, spray or gas applications bouncing off of the slanted ends 36 and 42 can cause the movement of the stent back and forth as the fixture 20 rotates. In some embodiments, the stent 10 can be securely pinched between the slanted ends 36 and 42 so as to be in constant contact with the stent during the coating process.

A second end 44 of the mandrel 24 can be permanently affixed to the lock member 26 if the end 40 is disengagable from the support member 22. Alternatively, in accordance with another embodiment, the mandrel 24 can have a threaded second end 44 for screwing into a bore 46 of the lock member 26. The bore 46 can be of any suitable depth that would allow the lock member 26 to be incrementally moved closer to the support member 22. The bore 46 can also extend completely through the lock member 26. Accordingly, the stents 10 of any length can be securely pinched between the support and the lock members 22 and 26. In accordance with yet another embodiment, a non-threaded second end 44 and the bore 46 combination is employed such that the second end 44 can be press-fitted or friction-fitted within the bore 46 to prevent movement of the stent 10 on the stent mandrel fixture 20.

During a spray coating process, the stent 10 rests on the spheres 48, which prevent the stent 10 from contacting the mandrel 24. Further, as the mandrel 24 rotates, the stent 10 also rotates, but not at 1:1 ratio since the stent 10 is not coupled to the spheres 48. As such, the point of contact between the inner diameter of the stent 10 and the spheres 48 constantly changes. Due to the constantly changing points of contact, the collection of excess coating at a single point is prevented, thereby minimizing the formation of clumps, which can lead to further defects, such as tears and rough surfaces, when the stent 10 is removed from the fixture 20. In addition, coating and/or air deflected from the slanted ends 36 and 42 cause translational motion of the stent 10 relative to the mandrel 24, thereby limiting contact of the stent 10 with the ends 36 and 42. In an embodiment of the invention, the slanted ends 36 and 42 are slanted in opposite directions such that the coating and/or the air is only deflected off on one of the ends 36 and 42 at a time.

In order to further reduce coating defects, the spheres 48 may be coated with one or more materials such as polymeric material having less adhesive force with the coating substance than with the spheres 48. Examples of a suitable materials include poly (tetrafluor ethylene) (e.g., TEFLON), fluorinated ethylene propylene ("FEP"), poly (vinylidene fluoride) ("PVDF"), poly (para-xylyene), polyamide (Nylon), polyolefins (e.g., high density poly (ethylene) and poly (propylene)), and polyacetal (DELRIN). In an alternative embodiment of the invention, the spheres 48 may be made of one or more of the non-stick polymeric materials.

The components of the coating substance or composition can include a solvent or a solvent system comprising multiple solvents, a polymer or a combination of polymers, a therapeutic substance or a drug or a combination of drugs. In some embodiments, the coating substance can be exclusively a polymer or a combination of polymers (e.g., for application of a primer layer or topcoat layer). In some embodiments, the coating substance can be a drug that is polymer free. Polymers can be biostable, bioabsorbable, biodegradable, or bioerodable. Biostable refers to polymers that are not biodegradable. The terms biodegradable, bioabsorbable, and bioerodable are used interchangeably and refer to polymers that are capable of being completely degraded and/or eroded when exposed to bodily fluids such as blood and can be gradually resorbed, absorbed, and/or eliminated by the body. The polymers can also be of the type that can be easily excreted from the body. The processes of breaking down and eventual absorption and elimination of the polymer can be caused by, for example, hydrolysis, metabolic processes, bulk or surface erosion, and the like.

Representative examples of polymers that may be used include, but are not limited to, poly(N-acetylglucosamine) (Chitin), Chitoson, poly(hydroxyvalerate), poly(lactide-co-glycolide), poly(hydroxybutyrate), poly(hydroxybutyrate-co-valerate), polyorthoester, polyanhydride, poly(glycolic acid), poly(glycolide), poly(L-lactic acid), poly(L-lactide), poly(D,L-lactic acid), poly(D,L-lactide), poly(D-lactic acid), poly(D-lactide), poly(caprolactone), poly(trimethylene carbonate), polyester amide, poly(glycolic acid-co-trimethylene carbonate), co-poly(ether-esters) (e.g. PEO/PLA), polyphosphazenes, biomolecules (such as fibrin, fibrinogen, cellulose, starch, collagen and hyaluronic acid), polyurethanes, silicones, polyesters, polyolefins, polyisobutylene and ethylene-alphaolefin copolymers, acrylic polymers and copolymers other than polyacrylates, vinyl halide polymers and copolymers (such as polyvinyl chloride), polyvinyl ethers (such as polyvinyl methyl ether), polyvinylidene halides (such as polyvinylidene chloride), polyacrylonitrile, polyvinyl ketones, polyvinyl aromatics (such as polystyrene), polyvinyl esters (such as polyvinyl acetate), acrylonitrile-styrene copolymers, ABS resins, polyamides (such as Nylon 66 and polycaprolactam), polycarbonates, polyoxymethylenes, polyimides, polyethers, polyurethanes, rayon, rayon-triacetate, cellulose, cellulose acetate, cellulose butyrate, cellulose acetate butyrate, cellophane, cellulose nitrate, cellulose propionate, cellulose ethers, and carboxymethyl cellulose. Representative examples of polymers that may be especially well suited for use include ethylene vinyl alcohol copolymer (commonly known by the generic name EVOH or by the trade name EVAL), poly(butyl methacrylate), poly(vinylidene fluoride-co-hexafluororpropene) (e.g., SOLEF 21508, available from Solvay Solexis PVDF, Thorofare, N.J.), polyvinylidene fluoride (otherwise known as KYNAR, available from ATOFINA Chemicals, Philadelphia, Pa.), ethylene-vinyl acetate copolymers, and polyethylene glycol.

"Solvent" is defined as a liquid substance or composition that is compatible with the polymer and/or drug and is capable of dissolving the polymer and/or drug at the concentration desired in the composition. Examples of solvents include, but are not limited to, dimethylsulfoxide, chloroform, acetone, water (buffered saline), xylene, methanol, ethanol, 1-propanol, tetrahydrofuran, 1-butanone, dimethylformamide, dimethylacetamide, cyclohexanone, ethyl acetate, methylethylketone, propylene glycol monomethylether, isopropanol, isopropanol admixed with water, N-methylpyrrolidinone, toluene, and mixtures and combinations thereof.

The therapeutic substance or drug can include any substance capable of exerting a therapeutic or prophylactic effect. Examples of active agents include antiproliferative substances such as actinomycin D, or derivatives and analogs thereof (manufactured by Sigma-Aldrich 1001 West Saint Paul Avenue, Milwaukee, Wis. 53233; or COSMEGEN available from Merck). Synonyms of actinomycin D include dactinomycin, actinomycin IV, actinomycin $I_1$, actinomycin $X_1$, and actinomycin $C_1$. The bioactive agent can also fall under the genus of antineoplastic, anti-inflammatory, antiplatelet, anticoagulant, antifibrin, antithrombin, antimitotic, antibiotic, antiallergic and antioxidant substances. Examples of such antineoplastics and/or antimitotics include paclitaxel, (e.g., TAXOL® by Bristol-Myers Squibb Co., Stamford, Conn.), docetaxel (e.g., Taxotere®, from Aventis S. A., Frankfurt, Germany), methotrexate, azathioprine, vincristine, vinblastine, fluorouracil, doxorubicin hydrochloride (e.g., Adriamycin® from Pharmacia & Upjohn, Peapack N.J.), and mitomycin (e.g., Mutamycin® from Bristol-Myers Squibb Co., Stamford, Conn.). Examples of such antiplatelets, anticoagulants, antifibrin, and antithrombins include aspirin, sodium heparin, low molecular weight heparins, heparinoids, hirudin, argatroban, forskolin, vapiprost, prostacyclin and prostacyclin analogues, dextran, D-phe-pro-arg-chloromethylketone (synthetic antithrombin), dipyridamole, glycoprotein platelet membrane receptor antagonist antibody, recombinant hirudin, and thrombin inhibitors such as Angiomax ä (Biogen, Inc., Cambridge, Mass.). Examples of such cytostatic or antiproliferative agents include angiopeptin, angiotensin converting enzyme inhibitors such as captopril (e.g., Capoten® and Capozide® from Bristol-Myers Squibb Co., Stamford, Conn.), cilazapril or lisinopril (e.g., Prinivil® and Prinzide® from Merck & Co., Inc., Whitehouse Station, N.J.), calcium channel blockers (such as nifedipine), colchicine, proteins, peptides, fibroblast growth factor (FGF) antagonists, fish oil (omega 3-fatty acid), histamine antagonists, lovastatin (an inhibitor of HMG-CoA reductase, a cholesterol lowering drug, brand name Mevacor® from Merck & Co., Inc., Whitehouse Station, N.J.), monoclonal antibodies (such as those specific for Platelet-Derived Growth Factor (PDGF) receptors), nitroprusside, phosphodiesterase inhibitors, prostaglandin inhibitors, suramin, serotonin blockers, steroids, thioprotease inhibitors, triazolopyrimidine (a PDGF antagonist), and nitric oxide. An example of an antiallergic agent is permirolast potassium. Other therapeutic substances or agents which may be appropriate agents include cisplatin, insulin sensitizers, receptor tyrosine kinase inhibitors, carboplatin, alpha-interferon, genetically engineered epithelial cells, steroidal anti-inflammatory agents, non-steroidal anti-inflammatory agents, antivirals, anticancer drugs, anticoagulant agents, free radical scavengers, estradiol, antibiotics, nitric oxide donors, super oxide dismutases, super oxide dismutases mimics, 4-amino-2,2,6,6-tetramethylpiperidine-1-oxyl (4-amino-TEMPO), tacrolimus, dexamethasone, ABT-578, clobetasol, cytostatic agents, prodrugs thereof, co-drugs thereof, and a combination thereof. Other therapeutic substances or agents may include rapamycin and structural derivatives or functional analogs thereof, such as 40-O-(2-hydroxy)ethyl-rapamycin (everolimus), 40-O-(3-hydroxy) propyl-rapamycin, 40-O-[2-(2-hydroxy)ethoxy]ethyl-rapamycin, and 40-O-tetrazole-rapamycin.

Figure 4:
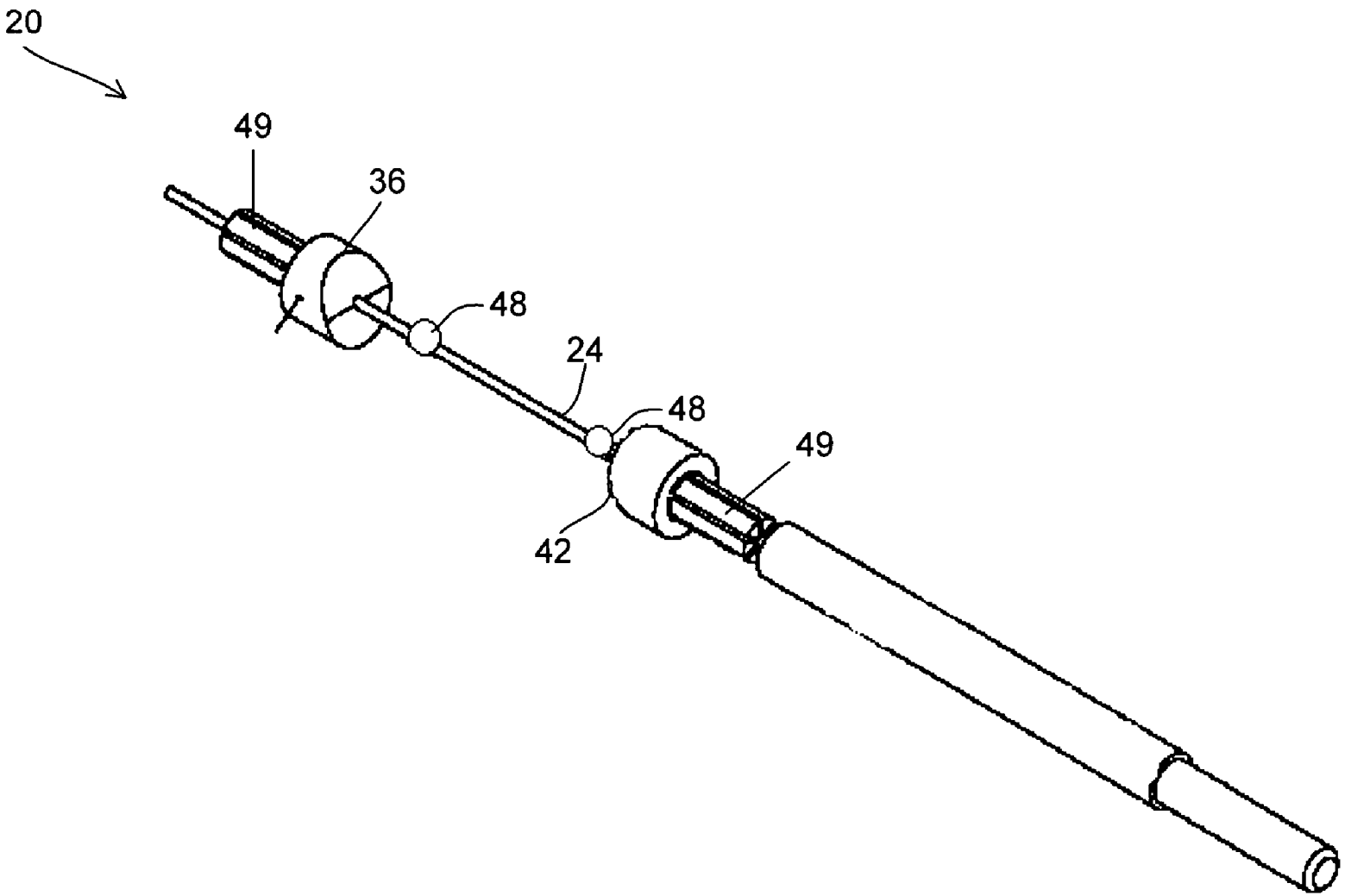
FIG. 4 is a diagram illustrating a perspective view of the stent fixture in accordance with another embodiment of the invention.

FIG. 4 is a diagram illustrating a perspective view of the stent mandrel fixture 20. In an embodiment of the invention, the mandrel 24 can be manufactured from nickel titanium. The spheres 48 can be made from stainless steel or other drug delivery stent manufacturing friendly materials. As mentioned above, to further reduce the likelihood of mandrel/stent interaction, the spheres 48 can be coated with a Teflon or Parylene-like coating to minimize the stent 10 sticking to the coating during processing. In an embodiment of the invention, the fixture 20 includes slotted pieces 20 coupled to the members 22 and 26. These slotted tubes 49 provide a friction fit for the members 22 and 26. They enable the slanted members 22 and 26 to be easily removed and replaced onto the mandrel 24.

It will be appreciated by one of ordinary skill in the art that the support member 22 and the lock member 26 can have different shapes. For example, the support member 22 and the lock member 26 can each have flat or tapered shapes. Further, the support member 26 and the lock member 26 do not need to have identical shapes.

Accordingly, as compared to conventional mandrels, embodiments of the invention reduce loading/unloading coating damage as the spheres 48 enable simple, smoother geometry that facilitates loading and unloading, thereby decreasing the likelihood of damaging coating on the stent 10 as compared to mandrels having coils thereon. Further, embodiments of the invention reduce coating damage during spray coating as the spheres 48 reduce the likelihood of coating accumulation and scraping of the inner stent 10 surface because of the spheres' 48 smooth surfaces. The mandrel 24 also enables tumbling of the stent 10 during a coating process, thereby enabling a more even distribution of coating on surfaces as compared to conventional mandrels.

Figure 5:
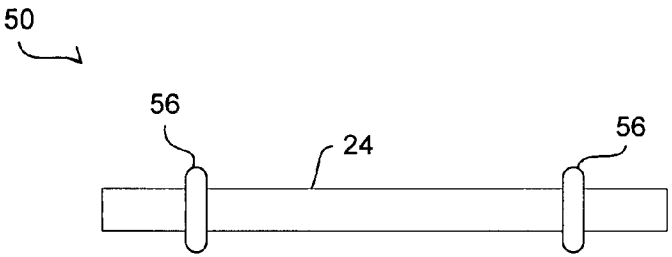
FIG. 5 is a diagram illustrating a stent mandrel according to another embodiment of the invention.

FIG. 5 is a diagram illustrating stent mandrel 50 according to another embodiment of the invention. The mandrel 50 is substantially similar to the mandrel 24 except that the mandrel 50 includes two cylinders 56, each having rounded smooth edges, in place of the spheres 48. The cylinders 56 have the same advantages as those mentioned above with respect to the spheres 48 since the cylinders 56 have non-sharp edges.

Figure 6:
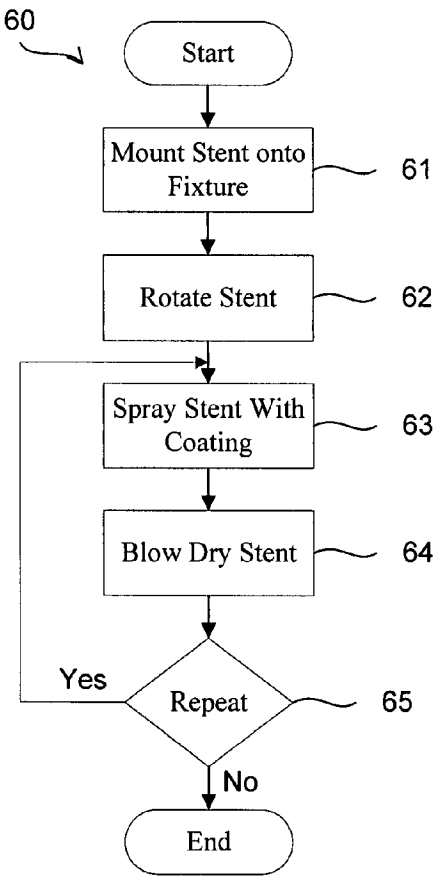
FIG. 6 is a flowchart illustrating a method of coating a stent.

FIG. 6 is a flowchart illustrating a method 60 of coating a stent. First a stent 10 is mounted (61) on a stent mandrel fixture, such as the stent mandrel fixture 20. Mounting (61) can include rotating the support member 22 vertically, inserting the mandrel 24 into the bore 38, placing the stent over the mandrel 24, and then inserting the mandrel 24 into the lock member 26. A high magnification video device can also be used during the mounting (61) to assist in adjusting the contact position between the spheres 48 or the cylinders 56 and the stent 10. The stent 10 is then rotated (62) and a coating is sprayed (63) on the stent 10 during the rotation (62). The stent is then blow dried (64) using an inert gas, such as Argon. The spraying (63) and drying (64) can be repeated (65) for multiple cycles with the same or different coating materials until a desirable thickness or weight is achieved. The method 60 then ends.

The foregoing description of the illustrated embodiments of the present invention is by way of example only, and other variations and modifications of the above-described embodiments and methods are possible in light of the foregoing teaching. For example, the cylinders 56 may also be coated with a non-stick polymeric material having less adhesive force with the coating substance than with the members.

What is claimed is:

1. A stent fixture for supporting a stent during a coating process, comprising:

a first member for being inserted at least partially into a longitudinal bore of a stent, the first member having at least one spherical component for making contact with the stent;

a second member coupled to one end of the first member and a third member coupled to another end of the first member, the spherical component being disposed between the second and third members; and a motor configured for rotating the spherical component about a longitudinal axis of the first member;

wherein the one end of the first member is received on an upwardly slanted face of the second member and the other end of the first member is received on a downwardly slanted face of the third member.

2. The stent fixture of claim 1, wherein the second and third member are in interim contact with the stent during the coating process.

3. The stent fixture of claim 1, wherein the stent is configured to move between the second member and third member during the coating process.

4. The stent fixture of claim 1, wherein the spherical component penetrates through a gap between struts of the stent such that a surface of the spherical component project out from an outer surface of the stent.

5. The stent fixture of claim 1, wherein the spherical component penetrates at least minimally through a gap between struts of the stent such that the surface of the spherical component does not project out from an outer surface of the stent.

6. The stent fixture of claim 1, wherein the spherical component prevents the first member from making contact with the stent.

7. The stent fixture of claim 1, wherein the spherical component can be moved incrementally with respect to the first member.

8. The stent fixture of claim 1, wherein the spherical component is made from or coated with a non-stick material.

9. The stent fixture of claim 8, wherein the non-stick material includes at least one material selected from a group consisting of poly (tetrafluor ethylene), fluorinated ethylene propylene, poly (vinylidene fluoride), poly (para-xylyene), and polyolefin.

10. The stent fixture of claim 1, wherein the second member is releasably coupled to the first member.

11. The stent fixture of claim 1, wherein the first member is movable relative to the second member when the first member is coupled to the second member.

12. The stent fixture of claim 1, wherein the geometric center of the spherical component is coincident with a longitudinal axis of the first member.

13. The stent fixture of claim 1, wherein the first member includes first and second spherical components.

14. A stent fixture, comprising:

a member having a component and first and second ends;

a motor configured for rotating the member about a longitudinal axis of the member;

a first support having a first slanted face and coupled to the member first end; and a second support having a second slanted face and coupled to the member second end;

wherein the component is disposed between the first and second supports; and wherein the member first and second ends are received on the first and second slanted faces such that a spray or gas bouncing off of the first and second slanted faces will cause back and forth movement of a stent supported on the member as the member rotates.

15. The stent fixture of claim 14, wherein the first slanted face is an upwardly slanted face and the second slanted face is a downwardly slanted face.

16. The stent fixture of claim 14, wherein the member extends towards an approximate center of the respective first and second slanted faces.

17. The stent fixture of claim 14, wherein the component is at least one spherical component.

* * * * *